United States Patent [19]

Tani et al.

[11] Patent Number: 4,564,560

[45] Date of Patent: Jan. 14, 1986

[54] RECORDING SHEETS FOR WATER BASE INK AND PROCESS FOR MAKING THE SAME

[75] Inventors: Hideki Tani, Tokorozawa; Makoto Arai; Takayuki Sasaki, both of Wakabayashi; Kazuhide Hayama; Akira Yamashita, both of Yokkaichi, all of Japan

[73] Assignees: Sanyo-Kokusaku Pulp Co., Ltd.; Mitsubishi Yuka Fine Chemicals Co., Ltd., both of Tokyo, Japan

[21] Appl. No.: 646,080

[22] Filed: Aug. 31, 1984

[30] Foreign Application Priority Data

Dec. 29, 1983 [JP] Japan ..... 58-250560

[51] Int. Cl.[4] ..... B41M 5/00

[52] U.S. Cl. ..... 428/411.1; 346/1.1; 346/135.1; 427/146; 427/261; 427/288; 428/195; 428/211; 428/478.2; 428/478.4; 428/478.8; 428/532; 428/535

[58] Field of Search ..... 346/1.1, 135.1; 400/126; 427/261, 288, 146; 428/207, 211, 537.5, 195, 478.2, 478.4, 478.8, 532, 533, 534, 535, 536, 411.1

[56] References Cited

U.S. PATENT DOCUMENTS 4,335,184 6/1982 Miyamoto et al. ..... 428/342

*Primary Examiner*—Bruce H. Hess

*Attorney, Agent, or Firm*—Oblon, Fisher, Spivak, McClelland & Maier

[57] ABSTRACT

A sheet for water base ink recording comprises a backing substrate including a surface layer obtained by ultraviolet or radiation curing of a composition composed mainly of an ultraviolet or radiation curing type resin starting from a natural high-molecular substance and, optionally, containing an ultraviolet or radiation curing type antistatic agent.

4 Claims, No Drawings

RECORDING SHEETS FOR WATER BASE INK AND PROCESS FOR MAKING THE SAME

FIELD OF THE INVENTION

The present invention relates to a recording sheet used with water base ink. More particularly, the invention is concerned with a sheet designed to be used in the ink jet recording, which is based on paper, plastic films, synthetic paper, metallic sheets, etc., and provides a printed image of high picture quality through the application of the ink jet recording.

BACKGROUND OF THE INVENTION

In recent years, the ink jet recording has increasingly been used in facsimiles, word processors, terminal printers, etc., since it causes no noise, needs no procedures for development and fixation, enables high-speed recording, and easily makes multi-color recording. Among others, the development is now being forwarded to color printers based upon the ink jet recording method for the purpose of making color hard copies from color displays.

The ink jet color printers have heretofore been used in a color graphics field wherein seven colors (yellow, magenta, cyan, red, green, blue, black) are used. In recent years, however, the development is now being forwarded to high-resolution color printers which give full-color copies of high quality comparable to that achieved by gravure printing or silver salt photography, the so-called pictorial color copies.

Ink jet recording is fundamentally advantageous in being capable of using plain paper, the so-called PPC (Plain Paper Copies). However, any satisfactory results are not yet obtained, if ordinary plain papers are used as the sheets for ink jet recording especially for multi-color recording.

The sheets for ink jet color recording are required to possess the basic properties that:

1. Ink dots are of a round shape, are not faded in color, and make a sharp contrast to their circumferences, thus leading to high resolution;
2. Ink dots are high in both color density and color saturation;
3. They absorb rapidly ink in a large amount, dry rapidly, and show good multi-color recording properties, by which, when ink dots are superposed upon each other, the outermost ink is prevented from flowing out; and
4. They show a dimensional stability with no fear of suffering curling, waving or deforming which may be caused by recording.

In particular, a major technical problem to be solved by those skilled in the art is to simultaneously achieve the opposite properties, one being ink absorptivity dominating the speed of ink drying and the other being dot spreading accompanied with low resolution. Generally, as the ink absorptivity of a recording sheet increases, the ink dot spreading increases so that the shape of ink dots is distorted, resulting in lowering of resolution. In addition, an ink tendency to penetrate deeply into the paper layer leads to lowering of color density and color saturation.

More particularly, when used the multi-color ink jet printer, the recording sheet used is required to possess high ink absorptivity, since the ink droplets of various colors are deposited onto the same or neighboring portions thereof within a very short time. Otherwise an unabsorbed amount of ink will flow, so that the resulting printed image will not only be unclear but will also be stained.

Fundamentally, normal paper such as fine paper may be used as the ink jet recording sheet. In this case, however, one skilled in the art should really regulate or select various paper properties such as the degree of sizing, air permeability, density, smoothness, and dimentional stability such as elongation in water, etc. depending upon the recording systems involved, the conditions applied or the ink used. On the other hand, it is substantially unfeasible to make color recording of high picture quality, now demanded, only through optimizing the above-mentioned properties of the normal paper. For that reason, an examination has been made of ink jet recording sheets having on their surface a coated layer wherein an optimized combination of pigments and binders is applied in order to meet the aforesaid fundamental requirements. However, there is not yet found any ink jet recording sheet for high picture quality, which is satisfactory in terms of recording performances as well as water resistance, weather resistance, dimensional stability and like other factors.

Recently, it is also demanded to use as the backing sheets not only papers but also impregnated paper sheets, plastic films, synthetic paper sheets, and metal sheets, which are water-resistant. Referring concretely to, for instance, increasing demand for color displays to be used with the computers for personal use, it is desired to develop transparent films, which make ink jet color recording possible, in order to use color hard copies with OHP (Overhead Projectors). However, any plastic films such as transparent polyester films used as the OHP films cannot be applied for that purpose, since, unlike paper, they are hydrophobic and, hence, are of no ink absorptivity at all. This also holds for other substrates such as impregnated papers, metalized papers, synthetic papers, metal sheets or the like.

As discussed above, some technical limits are placed on the development of ink jet recording sheets based on such new substrate materials, when it is attempted on the basis of the structural concept of the conventional ordinary of coated papers.

SUMMARY OF THE INVENTION

In view of the aforesaid considerations, the present inventors have intensively tried to develop the sheets for the ink jet recording, on which the images of high color picture quality are printed by the ink jet recording, and which are based on substrate materials such as impregnated papers, metallized papers, plastic films, synthetic papers, metallic sheets, etc., not to mention high-quality papers and coated papers. In consequence there are obtained utterly novel sheets for the ink jet recording, excelling in both ink jet recording properties and antistatic properties, which are characterized in that the substrates are coated with a resin composition containing as the main component an ultraviolet or radiation curing resin starting from natural high-molecular substances such as casein, gelatin, starch base polysaccharides, cellulose derivatives, etc., and optionally including an (cationic, anionic or ampholytic) ultraviolet or radiation curing antistatic agents, thereby to form an ultraviolet- or radiation-cured coating layer of said composition.

According to the first aspect of the present invention, there is obtained a sheet for the ink jet recording, excelling in both ink absorptivity and ink drying characteristics, and capable of providing color copies of high picture quality, in which a substrate is coated with a formulation containing as the main component an ultraviolet or radiation curing resin starting from a natural animal or vegetable high molecular substance such as casein, gelatin, starch base polysaccharides, cellulose derivatives etc., and the thus coated layer is exposed to ultraviolet light or radiation beam, thereby to form a cross-linked coating layer serving as a recording layer.

The ultraviolet or radiation curing casein, gelatin, starch base polysaccharides, cellulose derivatives and the like used in the present invention are prepared by allowing the starting water-soluble high molecular compounds to react with a compound containing a reactive double bond>C=C<capble of effecting a cross-linking reaction by ultraviolet or radiation energy. The coating layer obtained by exposing the resin to ultraviolet light or radiation beam combines hydrophilic nature resulting from the starting substance with, at the same time, hydrophobic and water-resisting nature resulting from the cross-linking reaction. The thus obtained recording sheet excels in water base ink-receptivity and -drying characteristics, in particular ink jet recording properties, and does not possibly undergo deformation such as surface waving at the printed portion which is often observed for ordinary and coated papers. The water absorption properties and drying characteristics of water base ink, the size and shape of ink dots, resolution and the water resistance of the surface recording layer depend upon the reactive double bond content of the ultraviolet or radiation curing resin forming the main component of the surface recording layer, or other compositions which are optionally added thereto, and comprise reactive or unreactive resins, and are determined depending upon the degree of cross-linking of the coated resin composition which is in turn determined by the ultraviolet or radiation exposure conditions. Consequently, the optimum recording layer in terms of the ink jet recording or the composition of ink is obtained through optimization of the aforesaid various conditions.

In order to make an ink jet record having a high quality printed image with high resolution, according to the second aspect of the present invention, there is provided a recording sheet having a surface recording layer obtained by adding to (A) the aforesaid curing resin (B) an ultraviolet or radiation curing type antistatic agent having an ionic conductive property such as an acrylic cation resin including an ultraviolet or radiation curing type quaternary ammonium base or an acrylic anion resin including an ultraviolet or radiation curing type carboxylate group, and curing the resulting composition.

According to this aspect of the present invention, it is possible to obtain a printed image of high density and excellent resolution, since the acidic and basic dyes used in the water base ink for ink jet recording are prevented from longitudinal and cross-sectional diffusion into the recording layer by making use of the property that such dyes are selectively absorbed onto the ion radicals of the ultraviolet or radiation curing type antistatic agent.

The water base ink for ink jet recording contains as the main components dyes serving as colorants and a liquid medium for dissolving and dispersing them and, if necessary, may include wetting agents, binders, viscosity modifiers, bacteriostats and the like.

As the colorants use may be made of direct, acidic and basic dyes. For instance, when use is made of ink in which —COOM or —$SO_3M$ (M is an alkali metal radical)-containing dyes are used, it is advantageous in view of recording performance to incorporate into the surface recording layer a cationic resin having an antistatic function.

The present invention has been accomplished based on the findings that extremely high picture quality is achieved by incorporating into the surface recording layer the ultraviolet or radiation curing antistatic agents based on its ionic conductive property.

The inventive sheets for water base ink recording, having the aforesaid features, are also best suited for drafting films by use of water base ink pens or for films for X-Y plotters using water base ink ball-points or felt pens.

Referring especially to the preparation of OHP transparent plastic sheets with the use of an X-Y plotter, it is now necessary to replace a color water base ink pen used with normal paper by an oil base pen.

However, the recording sheet of the present invention makes possible the use of a conventional water base ink pen, and dispenses with any troublesome replacement of pens.

In addition, the inventive water base ink recording sheet having a coated layer containing the ultraviolet or radiation curing antistatic agent has antistatic properties and, when used with a backing substrate film, is dust-proof and does not offer any static handling problem.

DETAILED DESCRIPTION OF THE INVENTION

The starting materials of the animal or vegetable polymeric or high-molecular substances for the ultraviolet or radiation curing type resins used in the present invention include, for instance, casein, gelatin, starch base polysaccharides (dextrin, soluble starch, alpha starch, pulran, etc.) and their derivatives as well as cellulose derivatives (nitrocellulose, carboxymethylcellulose-CMC, methylcellulose-MC, hydroxyprophylmethylcellulose-HPMC, ethylcellulose-EC, hydroxyethylcellulose-HEC, hydroxyprophylcellulose-HPC etc.). More specifically, the curing type resins include the following Chemical Substances I, II, III and IV starting from casein, gelatin, starch and CMC, as explained below in detail.

| | Starting Substance |
|---|---|
| Chemical Substance I (modified casein) | New Zealand Casein made by Fanleaf |
| Chemical Substance II (modified gelatin) | Gelatin P2115 made by Nitta Gelatin |
| Chemical Substance III (modified starch) | Hydroxyethylated Potato starch trade name AVELEX 2530 made by AVEBE |
| Chemical Substance IV (modified CMC) | Carboxymethylcellulose made by Sanyo Kokusaku Pulp |

The starting substance gelatin for Chemical Substance II may be made water-resistant by using metallic salts containing a trivalent metal such as chromium, aluminium or ferric iron, aldehydes, ketones, quinones and the like. According to the present invention, however, use is made of the ultraviolet or radiation curing type gelatin obtained by modifying the amino, imino, hydroxy and carboxyl groups contained in the gelatin molecule with a chemical substance having groups capable of reacting with them, thereby introducing the ultraviolet or radiation-reactive double bonds>C-=C<, grafting thereon a polymeric molecular chain having ultraviolet or radiation-reactive double bonds, or the like procedures. The thus obtained resin is exposed to ultraviolet light or radiation beam for cross-linking. Thus, the present invention makes it possible to provide an entirely novel, highly recordable sheet for ink jet recording by using the thus obtained water-resistant gelatin for a recording layer.

The procedures for preparing Chemical Substances I, II, III and IV involve the reactions between the relative starting materials casein, gelatin, starch, carboxymethylcellulose, etc., and (1) the epoxy groups of vinyl-epoxy compounds such as an allylglycidyl ether, styrylglycidyl ether, glycidyl acrylate, glycidyl methacrylate, glycidyl cinnamate and the like, (2) the carboxyl groups of vinyl-carboxylic acids such as acrylic, methacrylic, cinnamic, crotonic and other acids, (3) the hydroxyl groups of vinyl-hydroxides such as hydroxyethyl acrylate, hydroxyethyl methacrylate, hydroxypropyl acrylate, hydroxypropyl methacrylate and the like, (4) the methylol groups of vinyl N-methylol compounds such as N-methylolacrylamide, N-methylolmethacrylamide, and the like, (5) the halogen radicals of allyl halides, halomethyl styrene, haloalkyl acrylates, haloalkyl methacrylates and the like, (6) the aziridine groups of vinylaziridine compounds such as aziridinoalkyl acrylates, aziridinoalkylmethacrylates and the like, (7) the aldehyde groups of acrolein, methacrolein and other compounds, etc.

The ultraviolet or radiation curing type antistatic agents having ionic/conductive properties according to the second aspect of the present invention includes, for example, acrylic cation resins having quaternary ammonium bases or acrylic anion resins having carboxylate groups. For instance, the following chemical substances V, VI and VII, etc. may be used.

Chemical Substance V: Acrylic cation resin having a quaternary ammonium base

Chemical Substance VI: Acrylic anion resin having an acrylate group

Chemical Substance VII: Carboxybetaine type acrylic ampholytic resin

Reference is made to the preparation of these Chemical Substances V, VI and VII. Referring to the purpose of illustration, the Substance V may be obtained by modifying with a haloalkyl acrylate an acrylic resin formed by the copolymerization of N,N-dimethylaminoethyl methacrylate with other monomer; the substance VI may be obtained by modifying with hydroxyethyl acrylate an acrylic resin formed by the copolymerization of acrylic acid with other monomer, followed by neutralization with an alkali; and the Substance VII may be obtained by modifying with a haloalkyl acrylate and a sodium monohaloacetate an acrylic resin formed by the copolymerization of N,N-dimethylaminoethyl methacrylate with other monomer.

The coating compositions, which form a recording layer of the inventive sheet for water base ink recording, particularly the sheet for ink jet recording, are composed mainly of (A) the ultraviolet or radiation curing type casein, gelatin, starch base polysaccharides or cellulose derivatives, and comprise optionally (B) an ultraviolet or radiation curing type antistatic agent. The kind and the amount of the ultraviolet or radiation curing type antistatic agent can be determined with the kind and the amount of the dyes used in ink.

In addition to the above-mentioned ultraviolet or radiation curing type resins (A) and (B), the recording layer-forming formulations may contain water-soluble, reactive monomers and oligomers which are polymerized and crosslinked upon exposure to ultraviolet light or radiation beam, and emulsion-based, ractive resins as well as water-soluble, non-reactive high-molecular substances and resin components such as latexes and polyvinyl alcohol. Pigments, pigment dispersants, anti-foaming agents, UV absorbers and the like may be used.

The aforesaid resin formulations are coated by impregnation, size press, air knife, blade, bar, gravure, curtain, roll, spray or other like coatings, and the solvent is dried off, followed by exposure to ultraviolet light or electron beam, whereby the aforesaid ultraviolet or radiation curing type resin is polymerized and crosslinked to form a recording layer on the substrate sheet. The amount of the recording layer to be coated is in the range of 0.1 to 20 g/m$^2$, preferably 0.5 to 10.0 g/m$^2$. The substrate sheet used may be paper with controlled degree of sizing, air permeability and smoothness, processed paper having a barrier coating layer of resin or an extruded coating layer of thermoplastics, coated papers, cast papers, resin impregnated papers, papers containing synthetic fibers, synthetic pulp and inorganic fibers, metallized papers, synthetic papers, plastic films, metal films and the like.

For ultraviolet or radiation curing, use may be made of any one of ultraviolet lights emanating from, e.g., a high pressure mercury lamp, electron beam and gamma ray.

When using ultraviolet light, 0.5 to 5.0 weight parts of initiator for photo-induced cross-linking reaction are added to 100 weight parts of the ultraviolet curing type resin composition. The photo-initiators used may include ketones, benzoins, quinones, thioxantones, triazoles, salicylic acids or other known agents. Optionally, sensitizers may be employed. Such additives may not be necessary for electron beam curing.

In what follows, the present invention will now be explained in further detail with reference to the following non-restrictive examples, in which the term "part" shall refer to "part by weight", unless otherwise specified.

(A) Preparation of the Ultraviolet or Radiation Curing Type Resin

Chemical Substance I (modified casein)

100 parts of casein produced in New Zealand and processed by Fanleaf Co., Ltd. and 350 parts of a mixed water/isopropanol solvent (50:50 weight ratio) were charged in a flask, while they were stirred at 40° C. To the flask 2 parts of potassium hydroxide were added, and the resulting mixture was stirred for 30 minutes. Thereafter, 30 parts of glycidyl acrylate and 1 part of zinc oxide were further added, and the resultant mixture was heated to 60° C., at which it was stirred for further 30 hours to obtain Chemical Substance I.

Chemical Substance II (modified gelatin)

100 parts of gelatin (manufactured by Nitta Gelatin Co., Ltd. and sold under the trade name of P2115) were charged with 200 parts of 1.4-dioxane in a flask, while they were stirred at 60° C. To the flask 15 parts of acrylic acid and 0.5 part of P-toluenesulfonic acid were added, and the resulting mixture was stirred for further 20 hours, followed by the addition of 150 parts of water, thereby to obtain Chemical Substance II.

Chemical Substance III (modified starch)

100 parts of hydroxyethylated potato starch (manufactured by AVEBE Co., Ltd. and sold under the trade name of AVELEX 2530) and 400 parts of a mixed water/isopropanol solvent (60:40 weight ratio) were charged into a flask, while they were stirred at 50° C. To the flask 10 parts of glycidyl cinnamate and 0.3 part of tetramethylammonium bromide were added, and the resulting mixture was stirred for further 15 hours to obtain Chemical Substance III.

Chemical Substance IV (modified CMC)

100 parts of carboxymethylcellulose manufactured by Sanyo Kokusaku Pulp Co., Ltd. and 900 parts of a mixed water/isopropanol solvent (50:50 weight ratio) were charged into a flask, while they were stirred at 40° C. To the flask 5 parts of sodium hydroxide were added, followed by stirring for 30 minutes. Thereafter, 20 parts of 3-chloro-2-hydroxypropyl methacrylate were added, and the resulting solution was heated to 60° C., at which it was stirred for further 25 hours to obtain Chemical Substance IV.

(B) Preparation of the Ultraviolet or Radiation Curing Type Antistatic Agents

Chemical Substance V (Acrylic cation resin including quaternary ammonium base)

50 parts of N,N-dimethylaminoethyl methacrylate, 50 parts of methyl methacrylate, 100 parts of isopropanol and 0.5 part of 2,2'-azobisisobutyronitrile were charged into a flask, in which they were polymerized for 6 hours at 80° C. in a nitrogen atmosphere. The reaction product was then ice-cooled, to which 57 parts of 3-chloro-2-hydroxypropyl methacrylate and 250 parts of water were added dropwise. The thus prepared solution was stirred for 1 hour and then at 50° C. for 3 hours to obtain Chemical Substance V.

In its molecular chain, this acrylic polymer (hereinafteer referred to as Chemical Substance V) includes:

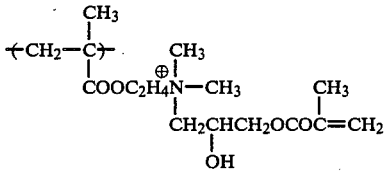

Chemical Substance VI (Acrylic anion resin including acrylate group)

50 parts of acrylic acid, 50 parts of ethyl acrylate, 100 parts of 1,4-dioxane and 0.5 part of 2,2'-azobisisobutyronitrile were charged into a flask, in which they were polymerized for 6 hours at 80° C. in a nitrogen atmosphere. Thereupon, 40 parts of 2-hydroxyethyl acrylate and 1.5 part of p-toluenesulfonic acid were added to the reaction product, and the resulting solution was stirred for 4 hours at 50° C. and ice-cooled, followed by dropwise addition of 14 parts of sodium hydroxide and 240 parts of water. The thus obtained solution was stirred for 1 hour and then at 40° C. for further 3 hours to obtain Chemical Substance VI.

In its molecular chain, this acrylic polymer (hereinafter referred to as Chemical Substance VI) includes:

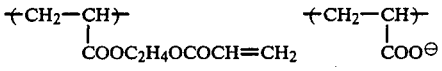

Chemical Substance VII (Carboxybetaine type acrylic ampholytic ion resin)

60 parts of N,N-dimethylaminoethyl methacrylate 40 parts of butyl methacrylate, 100 parts of isopropanol and 0.5 part of 2,2'-azobisisobutyronitrile were charged into a flask, in which they were polymerized for 6 hours at 80° C. in a nitrogen atmosphere. After ice-cooling, 28 parts of 2-chloroethyl methacrylate and 130 parts of water were added dropwise to the reaction product, and the whole was agitated for 1 hour and then at 50° C. for 3 hours. After further ice-cooling, 22 parts of sodium monochloroacetic acid and 100 parts of water were added dropwise to the mixture, and the solution was stirred for 1 hour and then at 40° C. for further 3 hours to obtain Chemical Substance VII.

In its molecular chain, this acrylic polymer (hereinafter referred to as Chemical Substance VII) includes:

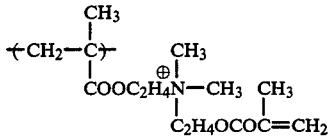

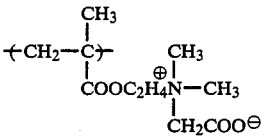

EXAMPLE 1

Preparation was first made of a solution of 10 weight % of a composition in a mixed water/isopropanol (50:50 weight ratio) solvent, said composition consisting of 100 weight parts of the ultraviolet curing type casein (Chemical Substance I) and 3 weight parts of an initiator manufactured by Stauffer Co., Ltd. and sold under the trade name of Vicure 55. This solution was coated onto a polyester film (100 microns) by means of a Mayer bar in such a manner that its content amounted to 2.0 g/m$^2$ in terms of dried solid, said film being previously coated with an anchor coating agent manufactured by Toyo Ink Seizo Co., Ltd. and sold under the trade name of Under Lacquer RU, 0.5 g/m$^2$. After drying, ultraviolet light was irradiated on it at a conveyor speed of 10 m/min. with the use of an ultraviolet curing apparatus (made by Ushio Denki Co., Ltd. and commercially available under the trade name of Unicure 4000, 160 W/cm) to prepare a transparent film for ink jet recording, including a set recording layer.

EXAMPLE 2

Preparation was first made of a 10 weight % solution of a composition in a mixed water isopropanol (50:50 weight ratio) solvent, said composition consisting of 100 weight parts of the ultraviolet curing type gelatin (Chemical Substance II) and 3 weight parts of an initiator available under the trade name of Vicure 55 (manufactured by Stauffer Co., Ltd.). This solution was coated onto a polyester film which had already been undercoated as described in Example 1, with the use of a Mayer bar in such a manner that its content amounted to 4.0 g/m$^2$ in terms of dried solid. After drying, ultraviolet light was irradiated (at a conveyor speed of 10 m/min.) to prepare a transparent film for ink jet recording, including a set recording layer.

EXAMPLE 3

A composition was first prepared consisting of the ultraviolet curing type casein (Chemical Substance I) and the ultraviolet curing type cationic antistatic agent (Chemical Substance V) in a solid proportion of 75:25. Preparation was then made of a solution of a 10 weight % formulation in a mixed water/isopropanol (50:50 weight ratio) solvent, said formulation consisting 100 weight parts of said composition and 3 weight parts of an initiator available under the trade name of Vicure 55 (manufactured by Stauffer Co., Ltd.). This solution was coated onto a polyester film which had been undercoated as described in Example 1, in such a manner that its content amounted to 4.0 g/m$^2$ in terms of dried solid. After drying, ultraviolet light was irradiated (at a conveyor speed of 10 m/min.) to prepare a set recording layer-containing transparent sheet of ink jet recording in which the ultraviolet curing type cationic antistatic agent was used.

EXAMPLES 4 AND 5

In place of the ultraviolet curing type cationic antistatic agent (Chemical Substance V) use was made of ultraviolet curing type anionic antistatic agent (Chemical Substance VI) and the ultraviolet curing type amphoteric antistatic agent (Chemical Substance VII). These agents were combined with the ultraviolet curing type casein (Chemical Substance I) in a proportion similar to that applied in Example 3, and were formulated with an initiator similar to that used in Example 3. From the obtained formulations, the transparent films for ink jet recording of Examples 4 and 5 were prepared according to Example 3.

EXAMPLE 6

10 weight % solutions of the radiation curing type casein (Chemical Substance I) and the radiation curing type gelatin (Chemical Substance II) in a mixed water/isopropanol (50:50 weight ratio) solvent were respectively coated onto the previously undercoated polyester films, as used in Example 1, by means of a Mayer bar in such a manner that their content amounted to 4.0 g/m$^2$ in terms of dried solid. Thereafter, the films were exposed to 1.0 Mrad of electron beam at an acceleration voltage of 150 KV and a beam current of 2.0 mA with the use of an electron beam irradiation apparatus (Electron Curtain CB 150/15/10 L manufactured by Energy Science Co., Ltd.) to obtain set recording layers. In this manner the transparent films (Ex. 6A and 6B) for ink jet recording were obtained.

EXAMPLE 7

Preparation was first made of a 10 weight % solution of a composition in a mixed water/isopropanol (50:50 weight ratio) solvent, said composition consisting of 100 weight parts of the ultraviolet curing type casein (Chemical Substance I) and 3 weight parts of an initiator available under the trade name of Vicure 55 (manufactured by Stauffer Co., Ltd.). This solution was coated onto the coated paper (SK Coat, tradename, manufactured by Sanyo Kokusaku Pulp Co., Ltd.) by means of a Mayer bar in such a manner that its content amounted to 4.0 g/m$^2$ in terms of dried solid. Thereafter, the paper was exposed to ultraviolet light at a conveyor speed of 10 m/min. to obtain a paper based sheet for ink jet recording.

The sheets of Examples 1–7, a commercially available high-quality paper for ink jet recording (Comparative Example 1) and the coated paper used in Example 7 (Comparative Example 2) were estimated on their ink jet recording performance in the following manner.

1. Measurement of Dot Optical Density and Diameter: measured by using Sakura Densitometer PDM-5 (manufactured by Konishiroku Kogyo Co., Ltd.)
2. Observation of Dot Shape: Observed by using a microscope
   - ○ Sharply contrasted round shape
   - Δ Round shape
   - × Distorted not round shape
3. Drying Rate of Ink: Measured by using Ink Jet Color Printer I0-0700 (manufactured by Sharp Co., Ltd.). When recording a test pattern, a sheet-keeping roller was placed on an imaged portion. Just after recording, the roller was fed forward to measure a stain in mm resulting from an undried amount of ink.
4. Surface Resistivity: Measured at 20° C. 65% RH with the use of Terao Meter, trade name, (manufactured by Kawaguchi Denki Co., Ltd.)
5. Water Resistance: A certain amount of water was added dropwise onto the coated film and, just thereafter, was wiped out to measure the degree of damaging thereof.
   - ○: Not damaged Δ: Somewhat damaged
   - ×: Entirely wiped out The results are shown in Table 1.

TABLE 1

| Samples | Dot Shape | Dot Diameter in μm | Dot Optical Density (Black) | Drying Rate of Ink (mm) | Surface Resistivity (Ω) | Water Resistance |
|---|---|---|---|---|---|---|
| Example 1 | | 160 | 1.82 | 5 | $3.8 \times 10^{12}$ | |
| Example 2 | | 170 | 1.80 | 0 | $4.5 \times 10^{14}$ | |
| Example 3 | | 200 | 1.78 | 0 | $6.3 \times 10^{10}$ | |
| Example 4 | | 204 | 1.50 | 7 | $1.1 \times 10^{11}$ | |
| Example 5 | | 210 | 1.72 | 0 | $2.3 \times 10^{11}$ | |
| Example 6 (A) | | 165 | 1.82 | 0 | $4.1 \times 10^{12}$ | |
| Example 6 (B) | | 170 | 1.80 | 0 | $5.2 \times 10^{14}$ | |
| Example 7 | | 160 | 1.78 | 5 | $2.8 \times 10^{12}$ | |
| Comparative Ex. 1 High Quality Paper | × | 310 | 1.10 | 0 | $7.2 \times 10^{11}$ | — |
| Comparative Ex. 2 | Δ | 280 | 1.70 | 13 | $6.5 \times 10^{12}$ | — |

TABLE 1-continued

| Samples | Dot Shape | Dot Diameter in μm | Dot Optical Density (Black) | Drying Rate of Ink (mm) | Surface Resistivity (Ω) | Water Resistance |
|---|---|---|---|---|---|---|
| Coated Paper | | | | | | |

The transparent sheets for ink jet recording according to Examples 1–5, 6A and 6B of the present invention were printed with the use of an ink jet color printer (I0-0700 manufactured by Sharp Co., Ltd.). As a result, it was found that the drying properties of the water base ink was good, and the printed portion was so good that it was not rubbed off at all. In addition, the printed image was of high color optical density, was clear and had a high resolution, so that it was best suited for use as a color OHP film.

The ink jet recording paper of Example 7 provided a clear printed mage of high color density and high resolution. Compared with the coated paper (Comparative Example 2) and the ink jet recording paper of high quality (Comparative Example 1), that sheet was of much higher picture quality.

The recording sheet of Example 1 according to the present invention was used for drawing with a water base ink pen (black, red, green, blue) by means of an X–Y plotter PL-2000 (manufactured by Yokokawa Electric Works Co., Ltd.). It was found that the drawn lines of various colors were excellent, and the drying properties of the ink was good. Ink adhesion was also good enough not to be rubbed off. Thus, that sheet was best suited for use as an OHP film.

What is claimed is:

1. A sheet for water base ink jet recording or X–Y plotter recording, in which a backing substrate includes a surface layer obtained by ultraviolet or radiation curing of a composition composed mainly of an ultraviolet or radiation curing type resin starting from a natural high-molecular substance.

2. A method for producing water base ink recording sheets by providing a backing substrate with a surface layer obtained by ultraviolet or radiation curing of a resin composition composed mainly of an ultraviolet or radiation curing type resin starting from a natural high-molecular substance.

3. A sheet for water base ink recording, in which a backing substrate includes a surface resin layer obtained by ultraviolet or radiation curing of a composition composed mainly of (A) an ultraviolet or radiation curing type resin starting from a natural high-molecular substance and containing (B) an ultraviolet or radiation curing type antistatic agent.

4. A method for producing water base ink recording sheets by providing a backing substrate with a surface resin layer obtained by ulraviolet or radiation curing of a composition composed mainly of (A) an ultraviolet or radiation curing type resin starting from a natural high-molecular substance and containing (B) an ultraviolet or radiation curing type antistatic agent.

* * * * *

UNITED STATES PATENT AND TRADEMARK OFFICE

CERTIFICATE OF CORRECTION

PATENT NO. : 4,564,560

DATED : January 14, 1986

INVENTOR(S) : Hideki TANI ET AL

It is certified that error appears in the above-identified patent and that said Letters Patent is hereby corrected as shown below:

In Table 1, columns 9-10, under "Dot Shape" and under "Water Resistance", Examples 1, 2, 3, 4, 5, 6A, 6B and 7 should be annotated by the symbol " O ".

Signed and Sealed this

*Twenty-fourth* Day of *June 1986*

[SEAL]

*Attest:*

DONALD J. QUIGG

*Attesting Officer*

*Commissioner of Patents and Trademarks*